US006663478B1

(12) United States Patent
Ulrich

(10) Patent No.: US 6,663,478 B1
(45) Date of Patent: Dec. 16, 2003

(54) SAND PAPER DISC LOADING DEVICE

(76) Inventor: Louis Ulrich, 13610 Fairgate Dr., Poway, CA (US) 92064

( * ) Notice: Subject to any disclaimer, the term of this patent is extended or adjusted under 35 U.S.C. 154(b) by 1 day.

(21) Appl. No.: 10/056,520

(22) Filed: Mar. 15, 2002

(51) Int. Cl.[7] ..... B24B 19/00
(52) U.S. Cl. ..... 451/458; 451/490
(58) Field of Search ..... 451/458, 453, 451/386, 490, 491, 342, 364; 269/290, 287, 288

(56) References Cited

U.S. PATENT DOCUMENTS 4,437,271 A * 3/1984 McAvoy ..... 451/532
4,558,542 A * 12/1985 Marton ..... 451/490
6,050,887 A * 4/2000 Chang ..... 451/458

* cited by examiner

*Primary Examiner*—Dung Van Nguyen
(74) *Attorney, Agent, or Firm*—Goldstein & Lavas, P.C.

(57) ABSTRACT

A sand paper disc loading device that allows sanding discs to be easily and accurately placed on a sander including a sand paper support adapted for holding a plurality of sanding discs. The sand paper support has a front surface and a back surface. The front surface has a plurality of dowels extending outwardly therefrom in a spaced relationship. The dowels are arranged to correspond with dust collection apertures of the sanding discs.

3 Claims, 5 Drawing Sheets

SAND PAPER DISC LOADING DEVICE

BACKGROUND OF THE INVENTION

The invention relates to a sand paper disc loading device that allows sanding discs to be easily and accurately placed on a sander.

Several references show various tools and accessories. U.S. Pat. No. 6,050,887 to Chang discloses a sand cloth packaging system comprised of a plurality of guide posts, allowing for labor-saving replacement for a vacuum type rotary sander. U.S. Pat. No. 4,558,542 to Marton and U.S. Pat. No. 4,437,271 to McAvoy disclose various circular disc assemblies.

While these units may be suitable for the particular purpose employed, or for general use, they would not be as suitable for the purposes of the present invention as disclosed hereafter.

SUMMARY OF THE INVENTION

It is an object of the invention to produce a sand paper disc loading device that allows sanding discs to be easily and accurately placed on a sander including a sand paper support adapted for holding a plurality of sanding discs. The sand paper support has a front surface and a back surface. The front surface has a plurality of dowels extending outwardly therefrom in a spaced relationship. The dowels are arranged to correspond with dust collection apertures of the sanding discs. The back surface has a handle extending outwardly therefrom. A support stand is adapted for removably coupling with the sand paper support. The support stand includes a base member positionable on a flat recipient surface. The support stand includes a support plate hingedly coupled with the base member. The support plate includes support means for locking the support plate in an angular orientation with respect to the base member. The support plate includes a recess extending inwardly of an upper edge thereof. The recess is dimensioned for receiving the handle of the sand paper support therein for supporting the sand paper support on the support plate.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1B:
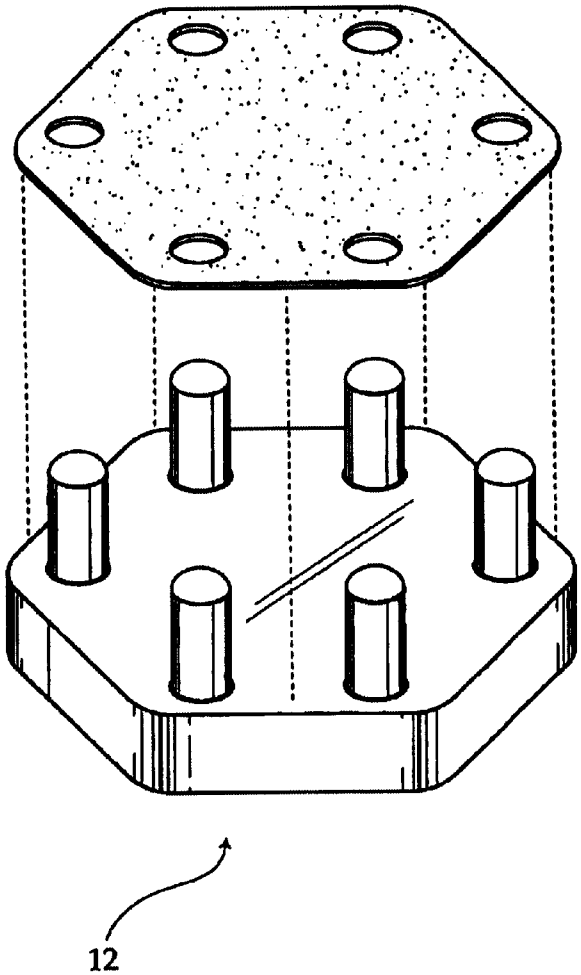
FIGS. 1*a* and 1*b* are perspective views of the present invention adapted for use with different styles of sand paper discs.
Figure 1A:
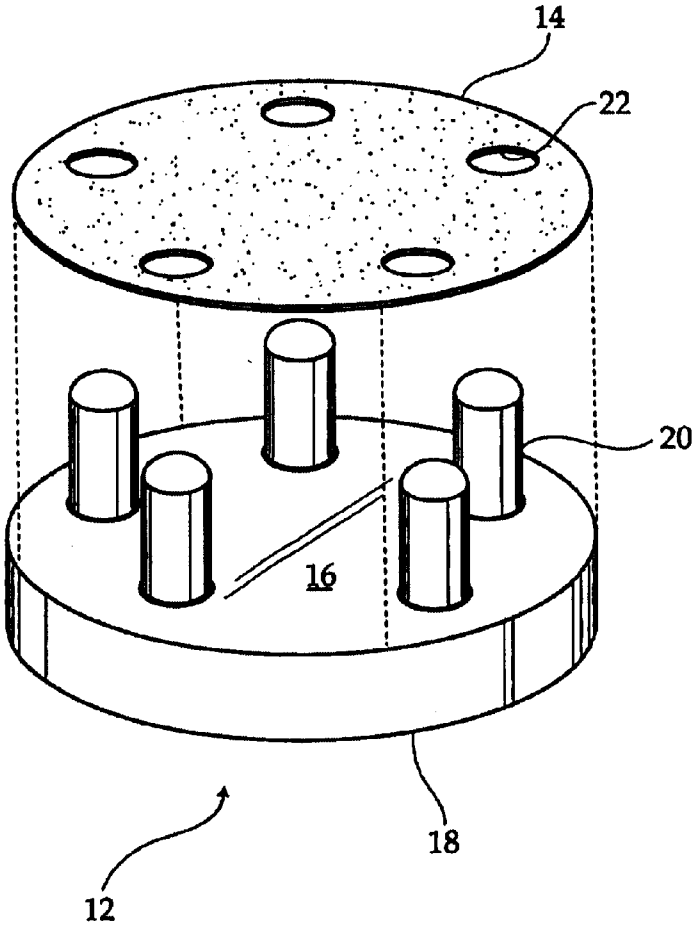
Figure 2:
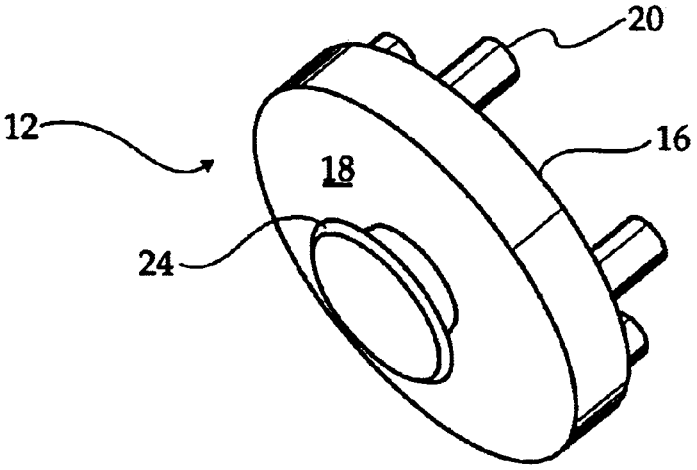
FIG. 2 is a rear perspective the sand paper support of the present invention.
Figure 3:
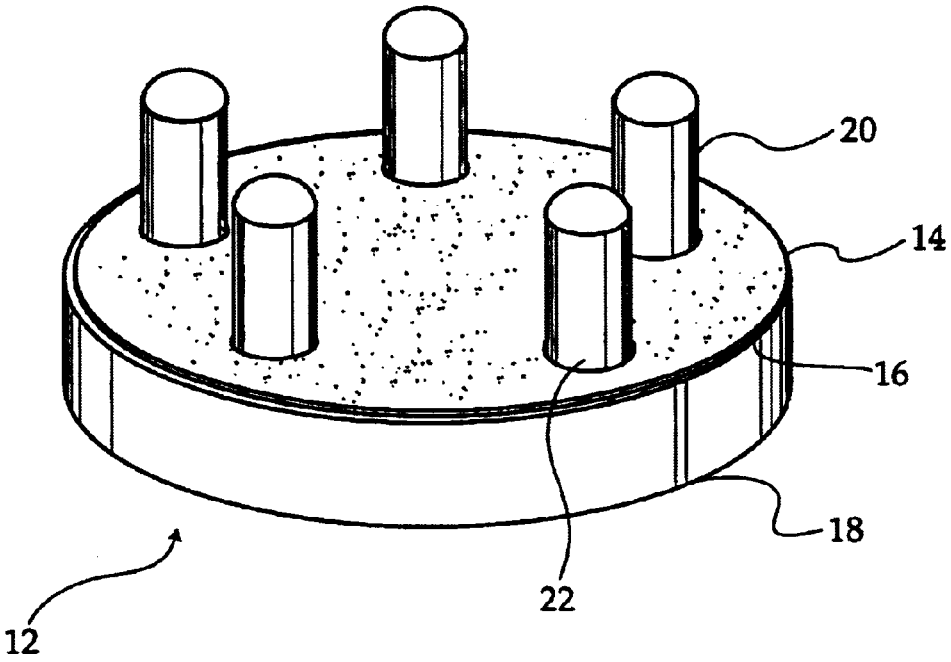
FIG. 3 is a plan perspective view of the sand paper support of the present invention.
Figure 5:
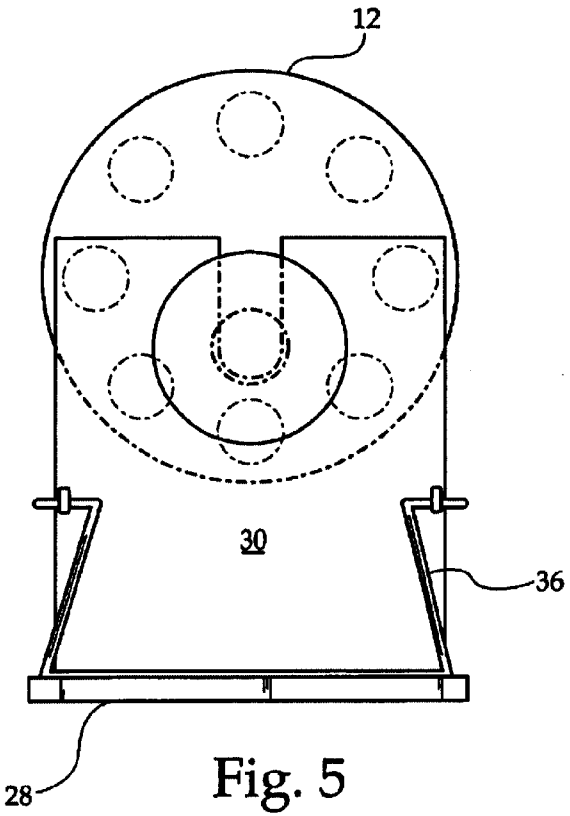
FIG. 5 is a rear view of the support stand illustrated in use.
Figure 4:
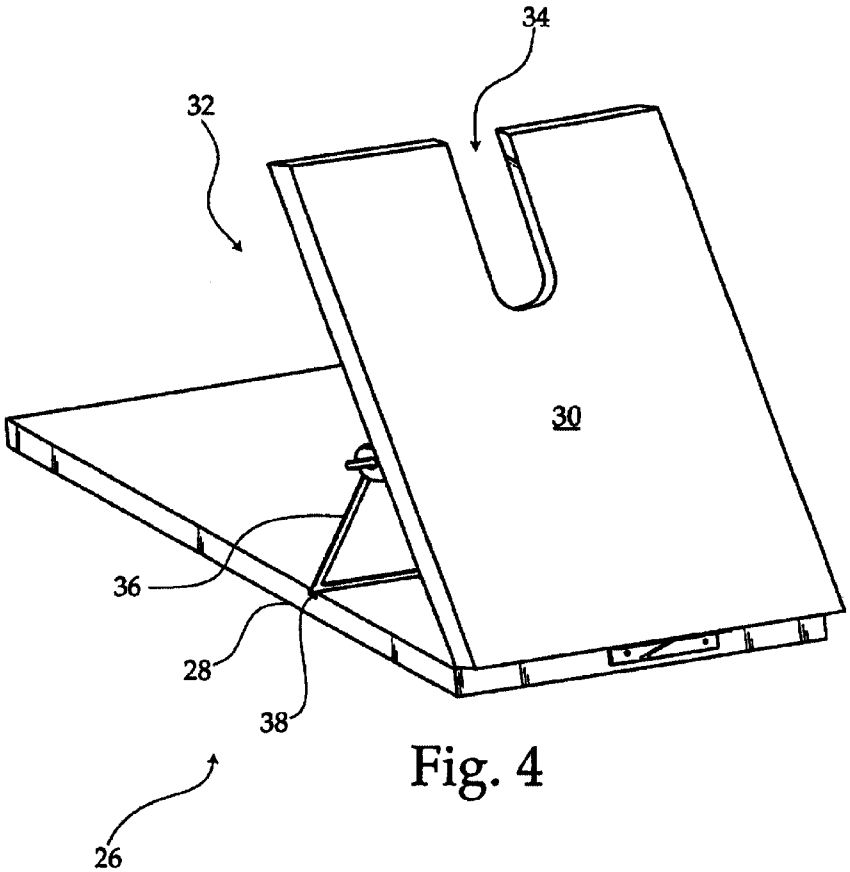
FIG. 4 is a perspective view of the support stand of the present invention.
Figure 7:
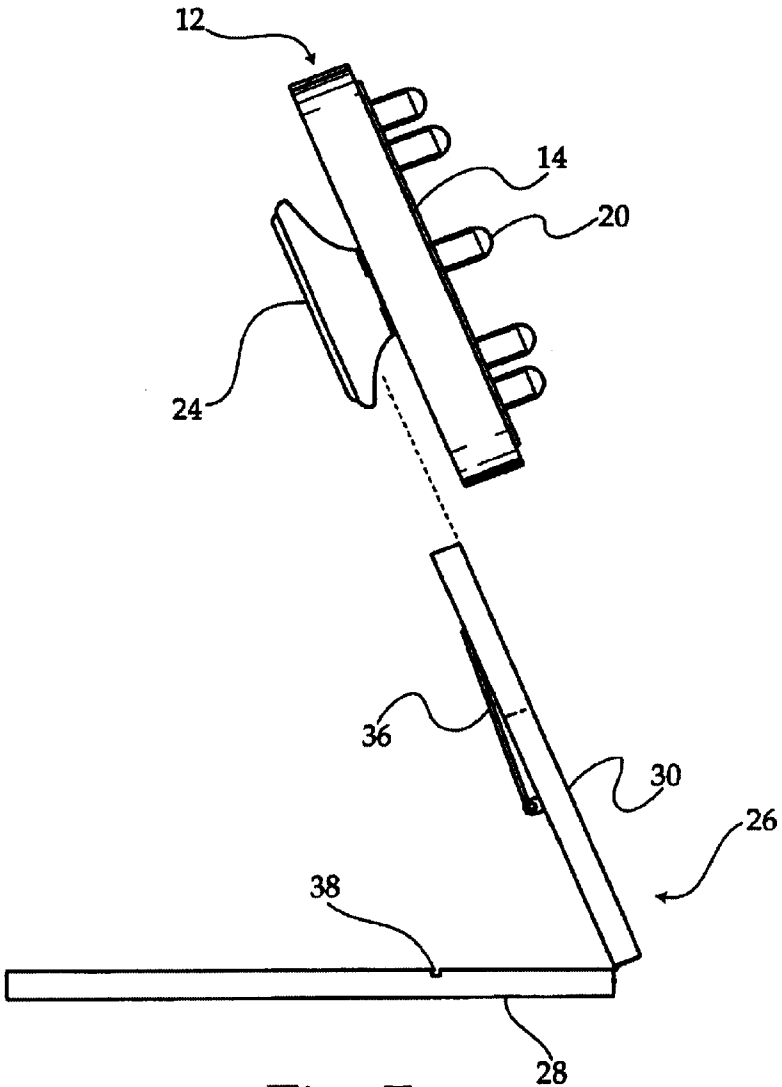
FIG. 7 is a side view of the support stand illustrating the removal of the sand paper support.
Figure 6:
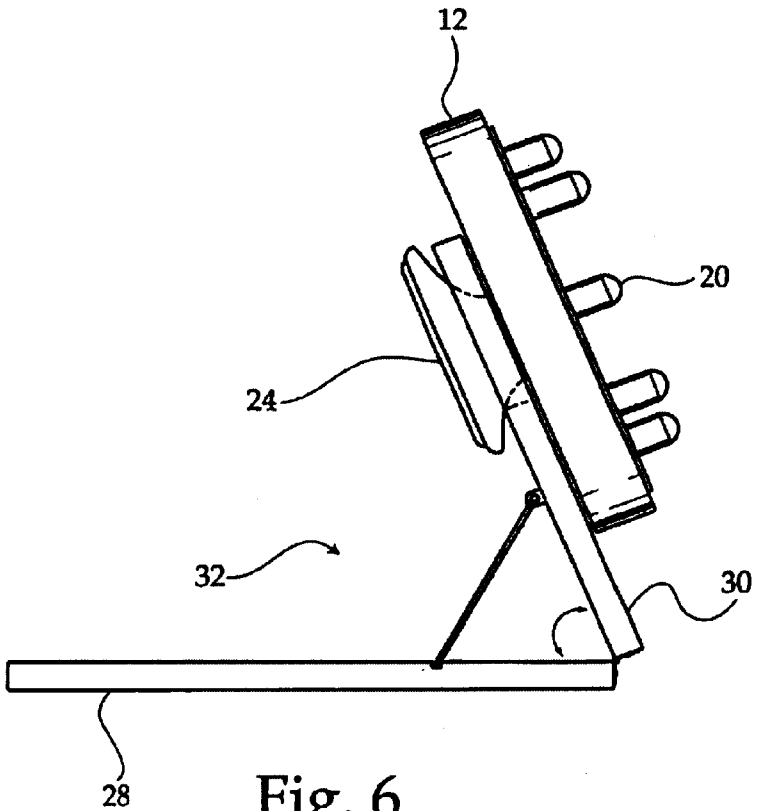
FIG. 6 is a side view of the support stand holding the sand paper support.
Figure 8:
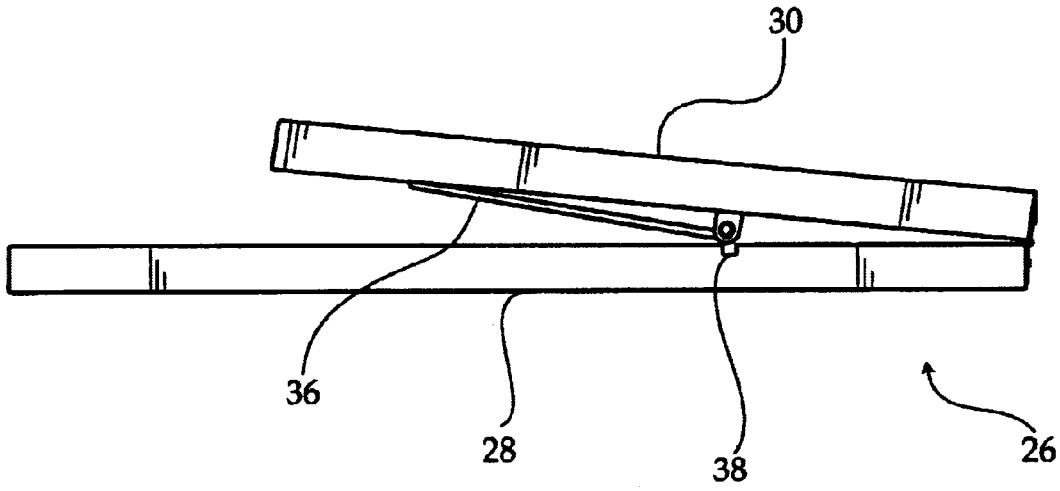
FIG. 8 is a side view of the support stand illustrated in a collapsed orientation.

It will be noted in the various figures that the device relates to a sand paper disc loading device that allows sanding discs to be easily and accurately placed on a sander. In its broadest context, the device consists of a sand paper support and a support stand. Such components are individually configured and correlated with respect to each other so as to attain the desired objective.

The sand paper support 12 is adapted for holding a plurality of sanding discs 14. The sand paper support 12 has a front surface 16 and a back surface 18. The front surface 16 has a plurality of dowels 20 extending outwardly therefrom in a spaced relationship. The dowels 20 are arranged to correspond with dust collection apertures 22 of the sanding discs 14. The back surface 18 has a handle 24 extending outwardly therefrom. In use, the sanding discs 14 will be placed with their abrasive surface against, or facing the front surface 16 of the sand paper support 12. When an initial, or new disc 14 is needed, the dowels 20 are aligned with the vacuum apertures of the sander so that the disc 14 can be properly positioned on the sander with the dust collection apertures 22 aligned with the vacuum apertures. This will insure proper operation of the sander and its dust collecting capabilities. It should be noted that the shape and size of the sand paper support 12 will correspond with the specific type of sander.

The support stand 26 is adapted for removably coupling with the sand paper support 12. The support stand 26 includes a base member 28 positionable on a flat recipient surface. The support stand 26 includes a support plate 30 hingedly coupled with the base member 28. The support plate 30 includes support means 32 for locking the support plate 30 in an angular orientation with respect to the base member 28. The support plate 30 includes a recess 34 extending inwardly of an upper edge thereof. The recess 34 Rot is dimensioned for receiving the handle 24 of the sand paper support 12 therein for supporting the sand paper support 12 on the support plate 30. In the preferred embodiment, the support means 32 includes a U-shaped bar 36 pivotally coupled with the support plate 30 and a notch 38 formed in the base member 28. The U-shaped bar 36 can be positioned within the notch 38 to allow the support plate 30 to be supported in the angular orientation with respect to the base member 28 to properly hold the sand paper support 12 for use with a sander.

What is claimed is:

1. A sand paper disc loading device that allows sanding discs to be easily and accurately placed on a sander, comprising:

a sand paper support adapted for holding a plurality of sanding discs, the sand paper support having a front surface and a back surface, the front surface having a plurality of dowels extending outwardly therefrom in a spaced relationship, the dowels being arranged to correspond with dust collection apertures of the sanding discs, the back surface having a handle extending outwardly therefrom; and a support stand adapted for removably coupling with the sand paper support, the support stand including a base member positionable on a flat recipient surface, the support stand including a support plate hingedly coupled with the base member, the support plate including support means for locking the support plate in an angular orientation with respect to the base member, the support plate including a recess extending inwardly of an upper edge thereof, the recess being dimensioned for receiving the handle of the sand paper support therein for supporting the sand paper support on the support plate.

2. A sand paper disc loading device that allows sanding discs to be easily and accurately placed on a sander, comprising:

a sand paper support adapted for holding a plurality of sanding discs, the sand paper support having a front surface and a back surface, the front surface having a plurality of dowels extending outwardly therefrom in a spaced relationship, the dowels being arranged to correspond with dust collection apertures of the sanding discs, the back surface having a handle extending outwardly therefrom.

3. The sand paper disc loading device as set forth in claim 2, and further including a support stand adapted for removably coupling with the sand paper support.

* * * * *